US010539007B2

(12) United States Patent
Dirksen et al.

(10) Patent No.: US 10,539,007 B2
(45) Date of Patent: Jan. 21, 2020

(54) TRACKING AND MEASUREMENTS ASSOCIATED WITH CEMENT PLUGS

(71) Applicant: HALLIBURTON ENERGY SERVICES, INC., Houston, TX (US)

(72) Inventors: Ronald Johannes Dirksen, Spring, TX (US); David Leonwill Jones, Duncan, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 123 days.

(21) Appl. No.: 15/533,991

(22) PCT Filed: Feb. 12, 2015

(86) PCT No.: PCT/US2015/015545
§ 371 (c)(1),
(2) Date: Jun. 7, 2017

(87) PCT Pub. No.: WO2016/130124
PCT Pub. Date: Aug. 18, 2016

(65) Prior Publication Data

US 2018/0313206 A1 Nov. 1, 2018

(51) Int. Cl.
*E21B 33/16* (2006.01)
*E21B 47/09* (2012.01)
(Continued)

(52) U.S. Cl.
CPC ..... *E21B 47/0905* (2013.01); *E21B 17/003* (2013.01); *E21B 17/206* (2013.01);
(Continued)

(58) Field of Classification Search
CPC ..... E21B 47/123; E21B 33/16; E21B 47/09; E21B 23/14; E21B 23/08; E21B 33/13; E21B 33/14; E21B 37/00
See application file for complete search history.

(56) References Cited

U.S. PATENT DOCUMENTS 4,779,201 A * 10/1988 Iizuka ..... E21B 47/0002 324/338
8,517,096 B2 * 8/2013 Vigneaux ..... E21B 47/102 166/253.1
(Continued)

OTHER PUBLICATIONS

Canadian Application Serial No. 2971847, Examiner's Letter, Apr. 23, 2018, 3 pages.
(Continued)

*Primary Examiner* — Kipp C Wallace
(74) *Attorney, Agent, or Firm* — Gilliam IP PLLC

(57) ABSTRACT

A cement head including a tubular body having a top end and a bottom end, and a borehole arranged through at least a portion of the tubular body; a cement plug arranged in the borehole and configured to exit the cement head upon releasing a retention device; and a spool assembly arranged on the tubular body, wherein the spool assembly comprises a drum rotatable about a central axis and a continuous cable having a first end and a second end, the first end being attached to the drum and the second end being attached to the cement plug, and wherein rotating the drum about the central axis results in spooling or unspooling the continuous cable about the drum.

20 Claims, 4 Drawing Sheets

(51) Int. Cl.

| | |
|---|---|
| ***E21B 17/00*** | (2006.01) |
| ***E21B 17/20*** | (2006.01) |
| ***E21B 33/05*** | (2006.01) |
| ***E21B 33/068*** | (2006.01) |
| ***E21B 33/12*** | (2006.01) |
| ***E21B 47/12*** | (2012.01) |
| ***E21B 47/14*** | (2006.01) |
| *E21B 34/02* | (2006.01) |
| *E21B 47/00* | (2012.01) |

(52) U.S. Cl.
CPC ..... *E21B 33/05* (2013.01); *E21B 33/068* (2013.01); *E21B 33/12* (2013.01); *E21B 33/16* (2013.01); *E21B 47/091* (2013.01); *E21B 47/122* (2013.01); *E21B 47/14* (2013.01); *E21B 34/02* (2013.01); *E21B 47/00* (2013.01)

(56) References Cited

U.S. PATENT DOCUMENTS 8,613,310 B2 12/2013 Denoix et al.
2002/0157828 A1* 10/2002 King ..... E21B 33/16 166/285
2004/0040705 A1* 3/2004 Harkins ..... E21B 33/072 166/250.01
2004/0060697 A1* 4/2004 Tilton ..... E21B 33/16 166/253.1
2011/0079401 A1* 4/2011 Gambier ..... E21B 23/08 166/384
2014/0034301 A1* 2/2014 Leblanc ..... E21B 33/16 166/250.14
2015/0337646 A1* 11/2015 Wang ..... E21B 47/0905 340/854.1

OTHER PUBLICATIONS

Australian Application Serial No. 2015382419; First Examination Report; dated Jan. 22, 2018, 3 pages.

International Search Report and Written Opinion for PCT/US2015/015545 dated Sep. 25, 2015.

* cited by examiner

TRACKING AND MEASUREMENTS ASSOCIATED WITH CEMENT PLUGS

BACKGROUND

The present disclosure is related to subterranean formation operations and, more particularly, monitoring the location of a cement plug during a cementing operation.

Hydrocarbon-producing wells (e.g., vertical, deviated, and horizontal wells in a subterranean formation) are generally drilled using a drilling fluid pumped down a drill string and through a drill bit attached to the end of the drill string. The drilling fluid serves, among other things, to lubricate and cool the cutting surfaces of the drill bit, transport drill cuttings to the surface, control formation pressure, and maintain well stability. After drilling is complete, a casing string may be placed in the wellbore through which hydrocarbons will eventually flow. An annulus is formed between the casing string and the face of the wellbore. A cement slurry is pumped through the casing string and displaces the drilling fluid up through the annulus. The cement slurry hardens in the annulus forming a cement sheath. This operation is termed "primary cementing." Among other things, the cement sheath may keep fresh water zones from becoming contaminated with produced fluids from within the wellbore. As used herein, the term "fluid" refers to liquid phase fluids and gas phase fluids. The cement sheath may also prevent unstable formations from caving in, thereby reducing the chance of a casing collapse and/or stuck drill pipe. Finally, the cement sheath forms a solid barrier to prevent fluid loss or contamination of production zones.

During the cementing process, a cementing head (also referred to as a cement head) houses and releases one or more cement plugs during a cementing operation. The cement head may be arranged on or otherwise mounted on the topmost joint of the casing string or at a location just above the rig floor. A first cement plug, referred to as a "bottom cement plug" (or "bottom plug") may be used to prevent or minimize contamination of the cement slurry with drilling fluid contained in a wellbore from the drilling operation. Such contamination could result in suboptimal hydration of the cement slurry, thereby compromising the integrity of the cement sheath, for example. The bottom cement plug may be released from the cement head and precede the cement slurry down the inside of the casing string to help separate the cement slurry from the drilling fluid. The bottom cement plug proceeds down the inside of the casing string until reaching a float collar located at or near the bottom end of the casing string, where it lands or "sits." Continued pressure from cement pumps open a passageway (e.g., a rupture disk, and the like) through the bottom cement plug, thereby permitting the cement slurry to pass through the bottom cement plug and up through the annulus.

A second cement plug, referred to as a "top cement plug" (or "top plug") may be released from the cement head as the last of the cement slurry enters the casing string. The top cement plug may be substantially similar to the bottom cement plug in most respects, but is solid rather than having a pressure opened borehole. The top cement plug follows the cement slurry down the inside of the casing string as a displacement fluid (e.g., water, seawater, drilling mud, or the like) is pumped behind the top cement plug. The top cement plug proceeds down the inside of the ceasing string until it reaches the bottom cement plug, where it lands or "sits," signaling a cement plug operator to cease operation of the cement pumps. As used herein, the term "cement plug" will be used collectively to refer to both the bottom and top cement plugs. Accordingly, the cement slurry is located only in the casing string below the cement plugs and in the annulus and the displacement fluid is located only above the cement plugs inside the casing string. Thereafter, the cement slurry is maintained in the annulus until it is hardened to form a cement sheath, as described above.

Optimal cementing operations depend, at least in part, on the location of the cement plugs within the inside of the casing string. Accurate identification of the location of the bottom cement plug, for example, is important to prevent over- or under-displacement of cement slurry. Over-displacement may result in moving all of the cement slurry into the annulus, thereby resulting in a cement deficiency at the bottom of the casing string. Under-displacement results in cement slurry hardening within the inside of the casing string at undesirable locations which must be removed for later production of the well. Accurate identification of the location of the top plug, for example, is important to signal cessation of cementing pumps. Successful placement of the cement plugs (e.g., "bumping" of the cement plugs), therefore, corresponds to a positive indication that the cement slurry has been optimally placed, thereby allowing the casing string to be tested and pressure-activated hangers or tools to operate, minimizing drill-out time, environmental risks, and other costly expenses.

BRIEF DESCRIPTION OF THE DRAWINGS

The following figure is included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
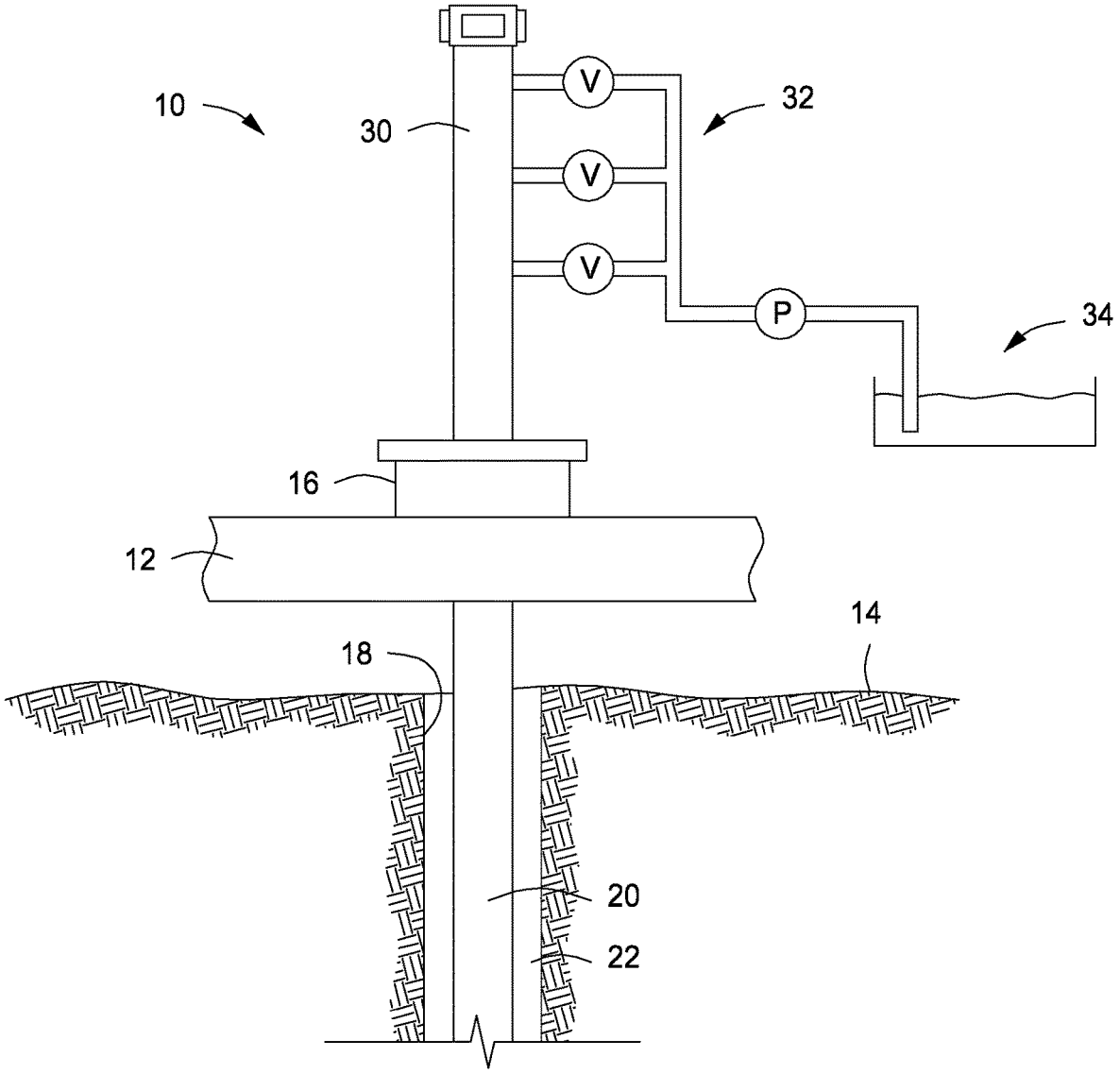
FIG. 1 depicts a schematic representation of a portion of a subterranean formation wellbore having a cement head in accordance with one or more embodiments of the present disclosure.

The present disclosure is related to subterranean formation operations and, more particularly, monitoring the location of a cement plug during a cementing operation. Specifically, the embodiments herein relate to a cement head comprising a spool assembly having a continuous cable that is unspooled from the spool assembly as cement plugs (e.g., bottom and top cement plugs) are released from the cement head. The location of the cement plugs may then be determined based on the length of the unspooled continuous cable, or by using a variety of telemetry methods using specialized materials forming the continuous cable, sensors, reflectors, and/or detectors. As used herein, the term "cable" refers to a wire or collection of wires, with or without an insulating coating.

One or more illustrative embodiments disclosed herein are presented below. Not all features of an actual implementation are described or shown in this application for the sake of clarity. It is understood that in the development of an actual embodiment incorporating the embodiments disclosed herein, numerous implementation-specific decisions must be made to achieve the developer's goals, such as compliance with system-related, lithology-related, business-related, government-related, and other constraints, which vary by implementation and from time to time. While a developer's efforts might be complex and time-consuming, such efforts would be, nevertheless, a routine undertaking for those of ordinary skill in the art having benefit of this disclosure.

It should be noted that when "about" is provided herein at the beginning of a numerical list, the term modifies each number of the numerical list. In some numerical listings of ranges, some lower limits listed may be greater than some upper limits listed. One skilled in the art will recognize that the selected subset will require the selection of an upper limit in excess of the selected lower limit. Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the exemplary embodiments described herein. At the very least, and not as an attempt to limit the application of the doctrine of equivalents to the scope of the claim, each numerical parameter should at least be construed in light of the number of reported significant digits and by applying ordinary rounding techniques.

While compositions and methods are described herein in terms of "comprising" various components or steps, the compositions and methods can also "consist essentially of" or "consist of" the various components and steps. When "comprising" is used in a claim, it is open-ended.

Referring now to FIG. 1, illustrated is a schematic representation of a portion of a subterranean formation wellbore having a cement head and cement plugs in operation therein. FIG. 1 generally depicts a land-based system; however, it is to be recognized that like systems may be operated in subsea locations as well, without departing from the scope of the present disclosure. Rig 10 is depicted in FIG. 1 comprising a floor 12 and a rotary table 16 located at the Earth's surface 14. The rotary table 16 may include a bushing and slips (not shown) for suspending a casing string 20 into a subterranean formation 18 (e.g., a wellbore in a subterranean formation 18 having hydrocarbon reservoirs therein). As used herein, the term "casing string," and grammatical variants thereof, refer to a length of a tubular configured suit a specific well and be cemented therein. A "tubular" may be any cylindrical or tub-shaped piping suitable for use in a subterranean formation.

Referring back to FIG. 1, the casing string 20 extends from the rig 10 and into the subterranean formation 18. As shown, an annulus 22 is formed between the wall of the subterranean formation 18 and the exterior of the casing string 20. The casing string 20 may be a single pipe or the casing string 20 may be a plurality of pipes each having a joint(s) to allow threading end-to-end thereof. The casing string 20 may also comprise a portion that extends above the surface 14, as depicted, although such a configuration does not limit the embodiments of the present disclose and the casing string 20 may be wholly within the subterranean formation 18 below the surface 14, without departing from the scope disclosed herein. The bottom end of the casing string 20 may comprise a float collar (not shown). As used herein, the term "float collar" refers to a component installed near the bottom end of a casing string onto which cement plugs land during primary cementing operations.

As shown in FIG. 1, a cement head 30 may be located above the floor 12 and generally attached to a top portion of the casing string 20 extending above the surface 14. However, the cement head 30 may additionally be located partially within the subterranean formation 18 or wholly within the subterranean formation 18 below the surface 14, provided that it is able to be adequately operated to introduce certain desired fluids therein, without departing from the scope of the present disclosure. As used herein, the term "cement head" refers to a device fitted to a top joint of a casing string to hold one or more cement plugs before they are pumped down the interior of the casing string during a cementing operation. The cement head 30 may comprise a substantially tubular body, as shown, having a bottom end and a top end, where the bottom end is directed toward the subterranean formation 18 below the surface 14 and the top end is directed away from the subterranean formation 18 above the surface 14, regardless of the location of the cement head 30 with reference to the surface 14. As shown in greater detail in FIG. 2 below, the cement head 30 further comprises a borehole through a portion of the tubular body. As used herein, the term "substantially" means largely but not necessarily wholly.

The cement head 30 may comprise a manifold 32 having valves V connected to a pump P that supplies fluids under pressure taken from a fluid source 34, for example. Although the manifold 32 is depicted as having three valves V, the manifold may have only a single valve V or two valves V, without departing from the scope of the present disclosure. Similarly, the cement head 30 may have greater than three valves V, without departing from the scope of the present disclosure. Generally, however, a cement head 30 will not have greater than about three valves V as part of the manifold 32.

The cement head 30, as previously stated, may be located at a top portion of the casing string 20 such that it is one of a type of wellhead fixture at the mouth of the well and has at least one entry passage into the subterranean formation 18 or at least one exit passage out of the subterranean formation 18 (e.g., the borehole). As depicted, the cement head 30 includes an entry into the subterranean formation 18 for one or more cement plugs as well as certain treatment fluids, released therefrom or therethrough, respectively, into the casing string 20.

Figure 2:
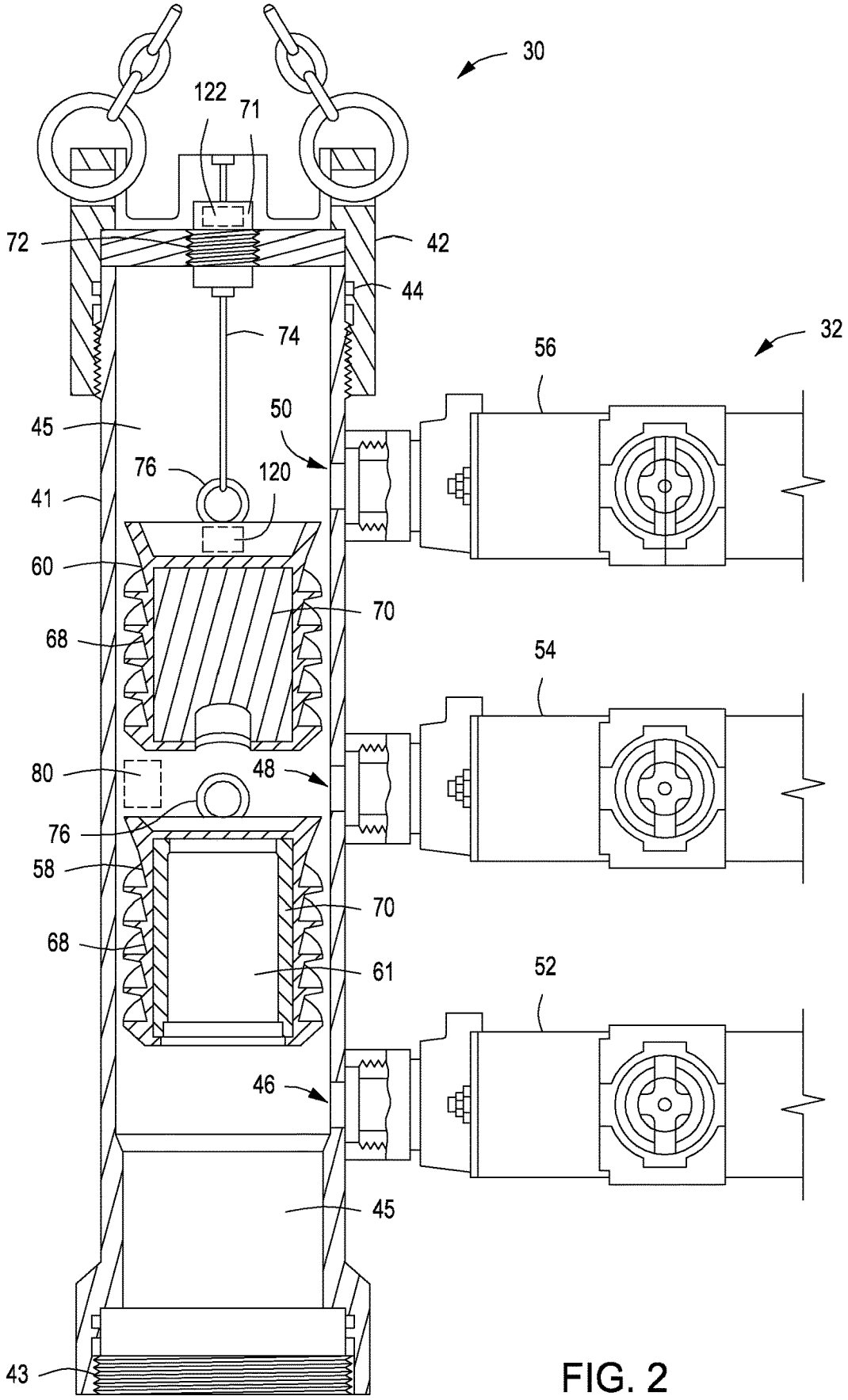
FIG. 2 depicts a cross-sectional side view of a cement head in accordance with one or more embodiments of the present disclosure.

Referring now to FIG. 2, with continued reference to FIG. 1, the cement head 30 of FIG. 1 is shown in greater detail as a cross-section thereof. As shown in FIG. 2, the cement head 30 comprises a tubular body 41 that includes a top end and the bottom end (not labeled), wherein the top end comprises a cap 42 and the bottom end comprises threading 43 to attach to the top portion of a casing string (e.g., the casing string 20 in FIG. 1) or an intervening adaptor. In some embodiments, the cap 42 may be permanently affixed to the top end of the tubular body 41, or, as shown, may be threaded thereto to allow removal of the cap 42. In all instances, the cap 42 will be considered an integral part of the tubular body 41, whether permanently attached or removable. For example, an O-ring seal 44 may be used to make the connection fluid-tight. Similarly, an O-ring seal may be used to connect the threading 43 to the top of a casing string or other connector. The tubular body 41 of the cement head 30 further comprises a borehole 45 through at least a portion thereof.

The manifold 32 (FIG. 1) of the cement head 30 is shown having a series of three vertically spaced valves 52, 54, and 56 (corresponding to the values V in FIG. 1). As discussed previously, three valves V are not required in accordance with the embodiments described herein, and less than three or more than three, may be included without departing from the scope of the present disclosure. Although each of the valves 52, 54, and 56 are illustrated in FIG. 2 as being equally spaced vertically along the cement head 30, they may be asymmetrically spaced vertically along the cement head 30. Similarly, the valves 52, 54, and 56 need not be on a single side of the cement head 30 and in parallel with one another; rather, they may be located at any location along the cement head 30, without departing from the scope of the present disclosure. As shown, each of the valves 52, 54, and 56 have a port 46, 48, and 50, respectively, in fluid communication with the borehole 45 of the cement head 30. Each of the valves 52, 54, and 56 may be connected to fluid lines for pumping fluids into a subterranean formation (e.g., subterranean formation 18 through casing string 20 of FIG. 1). The fluid lines may be connected to one or more fluid sources (e.g., fluid source 34 of FIG. 1), which may be a mixing hopper, a fluid storage truck, or the like. The fluid may be pumped into the borehole 45 of the cement head 30 through each of the valves 52, 54, and 56 and through each of the ports 46, 48, and 50, respectively, using a pump (e.g., pump P of FIG. 1).

The valves 52, 54, and 56 may have a shut-off device to allow an operator manually or through electronic means to open or close the valves 52, 54, and 56 to the ports 46, 48, and 50, thereby controlling the fluid that enters into the borehole 45 of the cement head 30. For example, the valve 52 may be connected to a fluid line comprising drilling fluid to be pumped after a drilling fluid, the valve 54 may be connected to a fluid line comprising a cement slurry, and the valve 56 may be connected to a fluid line comprising a displacement fluid, wherein valve 52 is first opened, followed by a simultaneous opening of valve 54 and closing of valve 52, followed by a simultaneous opening of valve 56 and closing of valve 54 to allow sequential introduction of each type of fluid. This example is non-limiting and other fluid configurations may be employed without departing from the scope of the present disclosure. Moreover, each of the valves 52, 54, and 56 need not be connected to fluid lines having different fluid types attached thereto, nor must each of valves 52, 54, and 56 be used in any particular operation. Rather, only two or one of the valves may be employed, without departing from the scope of the present disclosure.

As shown, two cement plugs are retained in the borehole 45 of the cement head 30. Bottom plug 58 and top plug 60 may be retained in the borehole 45 by any retention device (not shown) suitable for maintaining the cement plugs 58,60 in the borehole 45 and capable of releasing them from the borehole 45 at a designated time. In some embodiments, the retention device may comprise a conventional plug release plunger assemblies, a retractable support, an expandable support, a lever, and the like, and any combination thereof. The retention devices used in the embodiments herein may be manually operated or automated, without departing from the scope of the present disclosure. The removal of the retention device may also be coordinated with opening or closing the valves 52, 54, and 56 to ensure that the cement plugs 58,60 are placed in the casing string 20 (FIG. 1) in the proper order and location.

In a three valve system, the location of the valves 52, 54, and 56 may be positioned relative to the cement plugs 58, 60 such that they are adapted to be released from their retention device at a desired time and order. For example, the lowest valve 52 (i.e., closest to the bottom end of the cement head 30) is located below the bottom plug 58, the second lowest valve 54 is located between the bottom plug 58 and the top plug 60, and the highest valve 56 is located above the top plug 60. Accordingly, each of the cement plugs 58,60 may be released at the top or bottom portion of a fluid introduced into the cement head 30.

Each of the cement plugs 58,60 may be used to separate fluid types (e.g., drilling fluid, cement slurry, displacement fluid, and the like). For example, the bottom plug 58 may be used as an interface between a drilling fluid and a cement slurry, where the bottom plug 58 is pumped ahead of the cement slurry in the casing string 20 (FIG. 1). For example, a drilling fluid may be pumped through the lowest valve 52. After the drilling operation is completed and the casing string 20 placed into the subterranean formation 18 (FIG. 1), valve 52 may be closed, the bottom plug 58 released from its retention device (not shown), followed by opening of valve 54 which may be connected to a fluid line comprising a cement slurry. In such a manner, the bottom plug 58 traverses the casing string 20 ahead of the cement slurry. The bottom plug 58 may then reach a float collar (not shown) formed as part of the bottom of the casing string 20, where differential pressure ruptures a diaphragm or other rupture disk on a top portion of the bottom plug 58, thereby allowing the cement slurry to traverse through a plug opening 61 in the bottom plug 58, continue in the casing string 20 and up through the annulus 22 (FIG. 1) formed between the casing string 20 and the subterranean formation 18 (FIG. 1).

The top plug 60 may then be released from its retention device behind the cement slurry and ahead of a displacement fluid, which may be introduced through topmost valve 56. The top plug 60 does not include the plug opening 61 shown in bottom plug 58. The top plug 60 may otherwise be substantially similar in size and shape to the bottom plug 58, but designed to abut the bottom plug 58 on the float collar (not shown) to shut off fluid flow through the plug opening 61 of the bottom plug 58. In some embodiments, the top plug 60 may abut the bottom plug 58 by inserting in the plug opening 61 (e.g., using a shaped interface cut into the insert 70, discussed below), for example, although other means may also be utilized (e.g., threading, sealant, pressure seal, and the like), without departing from the scope of the present disclosure.

As shown, each of the cement plugs 58, 60 may comprise outer wiper elements 68 that wipe fluid residue from the inner diameter of the casing string 20 (FIG. 1). For example, the wiper elements 68 on the bottom plug may wipe the drilling fluid from the inner diameter of the casing string 20, and the wiper elements 68 on the top plug 60 may wipe the cement slurry from the inner diameter of the casing string 20. The wiper elements may be, for example, composed of a deformable material such as an elastomer including, but not limited to, natural rubber, nitrile rubber, styrene butadiene rubber, polyurethane, and the like. Other polymers or plastics that are deformable may also be used in accordance with the present disclosure. The wiper elements 68 may be molded to an insert 70 forming at least a portion of the interior of the cement plug 58,60 (i.e., a largely solid interior of top plug 60, but only a portion surrounding the plug opening 61 of the bottom plug 58). The insert may be made of a metal (e.g., aluminum), rubber, or polymeric material, including those disclosed above with reference to the wiper elements 68. Similarly, the rupture disk (not shown) of the bottom plug 58 may be a frangible metal, rubber, or polymeric material. In some instances, the rupture disk of the bottom plug 58 may preferably rupture at a pressure of between about 200 pounds per square inch (psi) to about 400 psi, encompassing any value and subset therebetween, and greater pressures.

Although the cement plugs 58,60 are depicted in FIG. 2 as wiper plugs, other types of cement plugs may be used in accordance with the embodiments of the present disclosure. Such cement plugs may include, but are not limited to, balls, wooden plugs, subsea plugs, teardrop plugs, latch-down plugs, and the like, and any combination thereof.

Referring again to FIG. 2, the cement head 30 may comprise a spool assembly 72 arranged on the tubular body 41. As shown, the spool assembly 72 is arranged within the borehole 45 of the tubular body 41 and attached to the cap 42, although other arrangements may be suitable, such as the spool assembly 72 being recessed in the tubular body 41 of the cement head 30. The spool assembly may include a drum 71 rotatable about a central axis (not labeled). Wrapped about the drum 71 of the spool assembly 72 is a continuous cable 74 having a first end and a second end. The first end of the continuous cable 74 is attached to a portion of the drum 71 and the second end of the continuous cable 74 is attached to the cement plug 58,60. As shown, the second end of the continuous cable 74 is attached to a top portion of the top cement plug 60 using an eyehook 76. As the top cement plug 60 is released from its retention device (not shown) and traverses the interior of the casing string 20 (FIG. 1), the continuous cable 74 is rotated off of the drum 71 of the spool assembly 72 in a controlled fashion. That is, the continuous cable 74 is unspooled from the drum 71 based on the lowering of the top cement plug 60 into the subterranean formation 18 (FIG. 1), such that the length of continuous cable 74 unspooled from the drum 71 is substantially equivalent to the depth or location of the top cement plug 60 in the subterranean formation 18, taking into account known distance factors (e.g., the length of the cable required to reach the surface 14 (FIG. 1) before entering the subterranean formation 18, the length of the cable between the spool assembly 72 and the top cement plug 60, cable stretch due to temperature, pressure, tension, and the like, and combinations thereof).

Although, the second end of the continuous cable 74 is depicted as being attached to the top cement plug 60, the bottom cement plug 58 may instead attach the second end of the continuous cable 74, without departing from the scope of the present disclosure. Moreover, multiple spool assemblies 72 may be arranged on the tubular body 41 of the cement head 30, such that both the top cement plug 60 and the bottom cement plug 58 are each individually attached to a spool assembly 72. For example, a second spool assembly may be located substantially side-by-side the depicted spool assembly 72 and have a continuous cable that extends past the top cement plug 60 and attaches to the bottom cement plug 58 with a second end thereof to an eyehook 76, for example. The continuous cable may extend past the top cement plug 60 by any means that does not interfere with the ability of the bottom cement plug 58 to be released from its retention device and traverse the subterranean formation 18 (FIG. 1) and unspool the continuous cable, and that does not interfere with the ability of the top cement plug 60 to be retained by its retention device until release is desired and traverse the subterranean formation 18 and unspool the continuous cable. In some embodiments, the mere pressure of the fluid (e.g., cement slurry) atop the bottom cement plug 58 will permit the continuous cable to unspool without interfering with either cement plug 58,60. In other embodiments, the continuous cable may be designed to be lubricated, or of a shape or configuration (e.g., flattened) that allows ease of extension past the top cement plug 60. In yet other embodiments, a portion of wiper elements 68 of the top cement plug 60 may be cut away and removed to provide a path for the continuous cable to extend therethrough while the bottom cement plug 58 traverses the subterranean formation 18 (FIG. 1). Such cut away may be just slightly larger than the width of the continuous cable and in a substantially vertical orientation through each wiper element 68 of the top cement plug 60.

In other embodiments, the bottom cement plug 28 may be attached to a spool assembly 80 (shown as a block in phantom). The spool assembly 80 may be substantially similar to the spool assembly 72, but arranged on the tubular body 41 of the cement plug 30 at a location below the top cement plug 60 and above the bottom cement plug 58. Similar to the cut away to allow the continuous cable to extend past the top cement plug 60, a cut away may be made to the wiper elements of the top cement plug 60 to allow the top cement plug 60 to be released from the cement head 30 past the spool assembly 80 without interfering with the movement of the top cement plug 60 therethrough. In other embodiments, the spool assembly 80 may be recessed into a wall of the tubular body 41 such that the top cement plug 60 slides past the spool assembly 80 without having contact therewith, or without having contact that is significant enough to interfere with the traverse of the top cement plug 60. In some embodiments, a cut away of the wiper elements 68 of the top cement plug 60 for the width of the continuous cable attached to the bottom cement plug 58 may still be desirable, although, as stated earlier, the pressure from the fluid atop of the top cement plug 60 may be sufficient to ensure that the presence of the continuous cable attached to the bottom cement plug 58 does not interfere with the traverse of the top cement plug 60 through the casing string 20 (FIG. 1).

FIG. 2 depicts an eyehook 76 for attaching the second end of the continuous cable 74 to the cement plugs 58, 60. However, any mechanisms for attaching the continuous cable to the cement plugs 58,60 may be used in accordance with the embodiments of the present disclosure, provided that the attachment means does not interfere with the rupture disk of the bottom cement plug 58, the ability of the top cement plug 60 to abut the bottom cement plug 58 and seal the plug opening 61 formed therethrough. For example, the attachment mechanism may be a hook and eye, an adhesive, welding or soldering the second end to the cement plug 58,60, and the like, and any combination thereof. Other attachment mechanisms may also be used, such as by braiding or otherwise attaching the continuous cable 74 to the cement plugs 58,60 by a knot or hitch, or the like. As used herein, the eyehook 76 will be used to refer to any attachment mechanisms for ease of description.

Figure 3A:
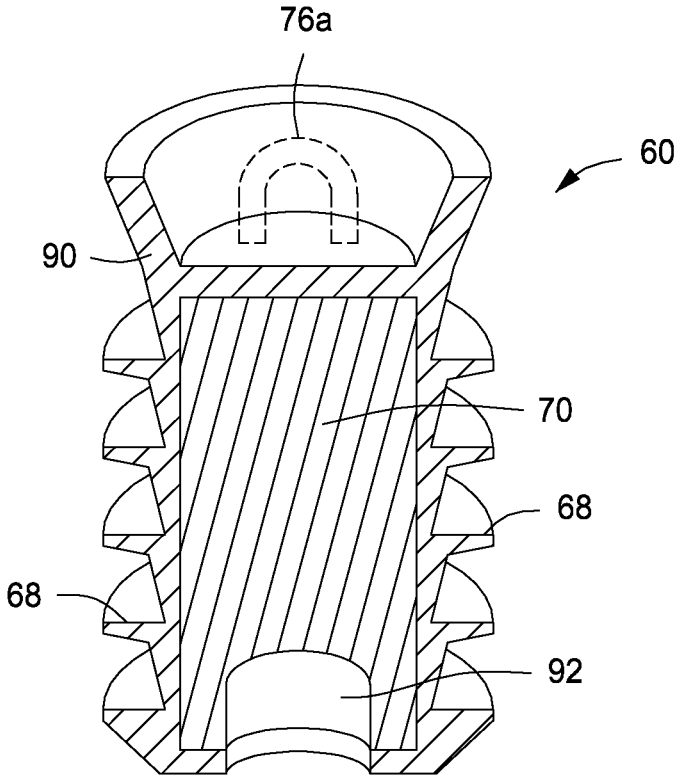
FIGS. 3A,3B illustrate a cross-section of a top cement plug and bottom cement plug having an attachment mechanism for attachment to a spool assembly according to one or more embodiments of the present disclosure.
Figure 3B:
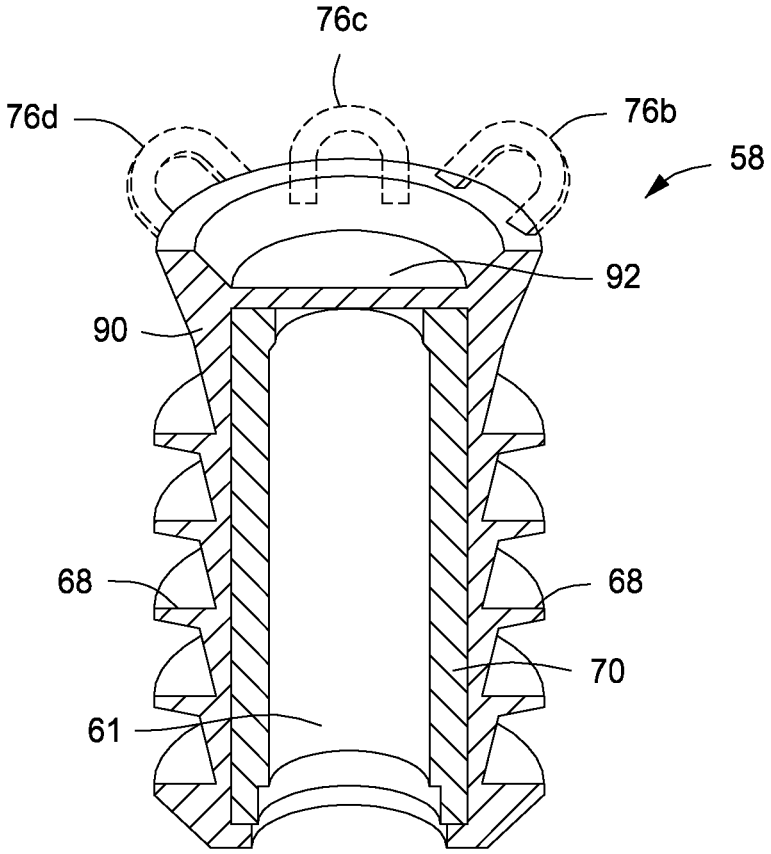

Referring now to FIG. 3A and FIG. 3B, with continued reference to FIG. 2. Labels used in FIG. 2 will be retained for reference to like elements in FIGS. 3A,3B. FIGS. 3A,3B illustrate a cross-section of a top cement plug 60 and bottom cement plug 58. Referring to both FIGS. 3A,3B, each cement plug 60,58 includes an outer portion 90, which define a plurality of wiper elements 68. An insert 70 is encompassed by the outer portion 90. As shown in FIG. 3A, the insert 70 is substantially solid, but may have a void 92 removed from a portion of the insert 70 or otherwise configured as part of the bottom portion of the top cement plug 60. In some embodiments, the eyehook 76 for attaching the second end of the continuous cable 74 may be located at a position on the top of the outer portion 90, as depicted by 76*a*. The eyehook 76*a* may similarly be located at any portion of the top of the outer portion 90, including in the recess or along the collar of the top portion, without departing from the scope of the present disclosure. The eyehook 76*a* may additionally be vertical (as shown) or angled, and may be located at a center location or offset from the center.

Referring now to FIG. 3B, three different non-limiting locations for an eyehook 76 on a bottom cement plug 58 for connecting the second end of the continuous cable 74 of the embodiments herein are depicted as 76*b*, 76*c*, and 76*d*. Eyehook 76*b* may be located along the top of the collar of the outer portion 90 and may be angled so as to not interfere with the setting of the top cement plug 60 (FIG. 3A) onto the bottom cement plug 58. In other embodiments, the eyehook 76*d* may be located on an exterior portion of the outer portion 76 and angled similarly so as to not interfere with the setting of the top cement plug 60 (FIG. 3A) onto the bottom cement plug 58. The eyehook 76*c* may also be located on the interior collar of the outer portion 90, so as to allow the rupture disk 92 to rupture and permit fluid flow therethrough without interfering with the attachment of the eyehook 76*c* or the continuous cable. In some instances, 76*c* may be vertically configured (as shown) or may also be angled to facilitate placement of the top cement plug 60 (FIG. 3A) onto the bottom cement plug 58, as described herein. The void 92 of the top cement plug 60 (FIG. 3A) may facilitate setting of the top cement plug 60 onto the bottom cement plug 58 by allowing the eyehook 76*c* to fit within the void 92. In each instance, if desired, a cut away may be removed from the wiper elements 68 and/or outer portion 90 of the top cement plug 60 (FIG. 3A) to allow passage of the continuous cable attached to the bottom cement plug 58.

Figure 4:
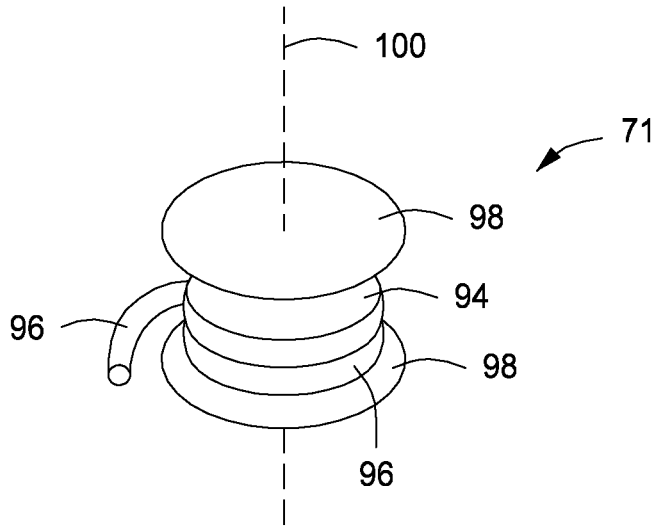
FIG. 4 illustrates a drum according to one or more embodiments of the present disclosure.

Referring now to FIG. 4, with continued reference to FIG. 2, illustrated is a drum 71 that may be used with the spool assemblies of the present disclosure. The drum 71 comprises a cylindrical body 94 having two ends. The drum 71 may be rotatable about a central axis 100. A continuous cable 96 having a first and second end may be coiled about the cylindrical body 94 of the drum 71, wherein the first end of the continuous cable 94 is attached to the cylindrical body 94 of the drum 71 such that rotating the drum 71 about the central axis 100 results in spooling or unspooling the continuous cable 94 about the cylindrical body 94 of the drum. Although the central axis 100 of the drum is depicted as substantially vertical in FIG. 4, the central axis 100 may also be substantially horizontal, without departing from the scope of the present disclosure. As depicted, the drum 71 may have two ends that may be capped with flanges 98. The flanges may aid to prevent the continuous cable 96 from being removed from the drum 71 without deliberate rotation, such as by releasing a cement plug 58,60 (FIG. 2) and allowing the cement plug 58,60 to traverse a casing string 20 in a subterranean formation 18 (FIG. 1). In some embodiments, the drum 71 may further comprise a covering (not shown) that covers the continuous cable 96 or a spooling guide (not shown) to guide the spooling and unspooling of the continuous cable 96 onto the drum 71, without departing from the scope of the present disclosure.

The continuous cable 96 of the present disclosure may be any material suitable for use in a subterranean formation operation. Suitable materials may include, but are not limited to, metals, such as steel wire, which may be reinforced with other metal wires, non-metal wires, natural fibers, synthetic fibers, which themselves may be reinforced with other materials such as KEVLAR®, available from DUPONT™ in Wilmington, Del. In other embodiments, the continuous cable 96 may be an electrically conductive cable, an optically conductive cable, an acoustically conductive cable, and any combination thereof.

The electrically conductive cable forming the continuous cable 96 may be made of any material capable of transmitting an electrical signal therethrough. Suitable materials for forming an electrically conductive continuous cable 96 may include, but are not limited to, a copper cable, a silver cable, an aluminum cable, a tungsten cable, other electrically conductive material, and the like, and any combination thereof. In some embodiments, the electrically conductive continuous cable 96 may be electrically insulated in an electrical insulating material. The electrical insulating material may be of a material such internal electric charges to not flow freely therein, making it difficult to conduct an electric current under the influence of an electric field. Suitable electrical insulating material may include, but is not limited to, a resin, an elastomer, a rubber, a ceramic, and the like, and any combination thereof.

The optically conductive cable forming the continuous cable 96 may be of any material capable of transmitting an optical signal therethrough. Suitable materials for forming the optically conductive continuous cable 96 may include, but are not limited to, an optical fiber, which may be glass or plastic. For example, the glass optical fiber may be reinforced or protected with another material, such as any of those provided herein. The optically conductive continuous cable 96 may also be jacketed in a material such as, for example, low smoke zero halogen, polyvinyl chloride, polyethylene, polyurethane, polybutylene terephthalate, polyamide, and the like, and any combination thereof.

The acoustically conductive cable forming the continuous cable 96 may be of any material capable of transmitting an acoustic signal therethrough. Suitable materials for forming the acoustically conductive continuous cable 96 may include, but are not limited to, a transmission line, such as a coaxial cable, a balanced line, a twisted pair, a star quad, and the like, and any combination thereof.

In some embodiments, the continuous cable 96 of the present disclosure may have a length sufficient to place a cement plug in a subterranean formation. In some embodiments, the continuous cable 96 of the present disclosure may have a non-limiting length in the range of a lower limit of about 1500 feet (ft), 2000 ft, 2500 ft, 3000 ft, 3500 ft, 4000 ft, 4500 ft, 5000 ft, 5500 ft, 6000 ft, 6500 ft, 7000 ft, 7500 ft, 8000 ft, and 8500 ft to an upper limit of about 15000 ft, 14500 ft, 14000 ft, 13500 ft, 13000 ft, 12500 ft, 12000 ft, 11500 ft, 11000 ft, 10500 ft, 10000 ft, 9500 ft, 9000 ft, and 8500 ft (about 457 meters to 4572 meters), encompassing any value and subset therebetween. The width of the continuous cable 96 may depend on the type of continuous cable selected and its tensile strength. In some embodiments, the width of the continuous cable 96 may be in the range of a lower limit of about 2 micrometers (μm), 10 μm, 50 μm, 100 μm, 250 μm, 500 μm, 750 μm, 1000 μm, 1250 μm, 1500 μm, 1750 μm, and 2000 μm to an upper limit of about 5000 μm, 4750 μm, 4500 μm, 4250 μm, 4000 μm, 3750 μm, 3500 μm, 3250 μm, 3000 μm, 2750 μm, 2500 μm, 2250 μm, and 2000 μm, encompassing any value and subset therebetween.

Figure 5:
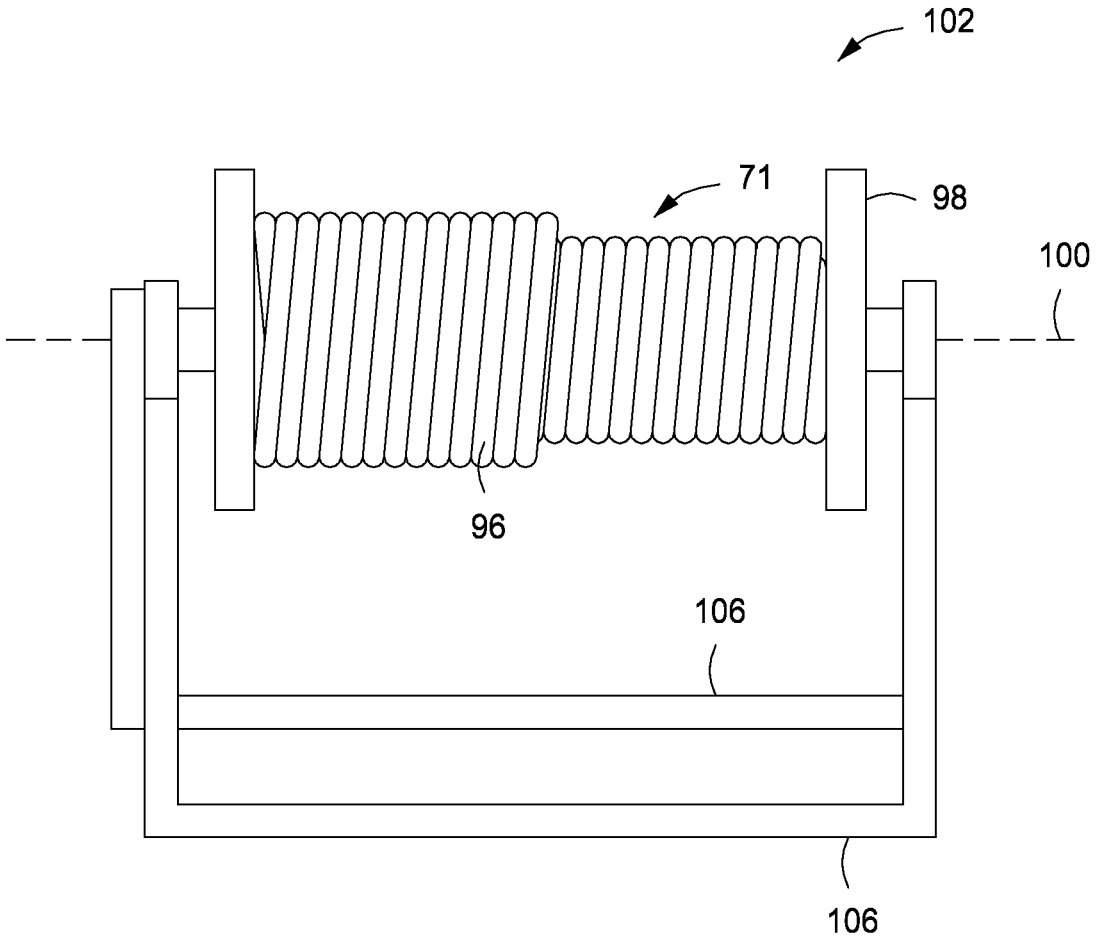
FIG. 5 illustrates a spool assembly according to one or more of the embodiments of the present disclosure.

Referring now to FIG. 5, with continued reference to FIG. 4, illustrated is a non-limiting example of a spool assembly 102 according to one or more embodiments of the present disclosure. As shown, the spool assembly 102 may comprise a drum 71 rotatable about a central axis 100, depicted as a substantially horizontal axis 100, having a continuous cable 96 at least partially spooled onto the drum 71, and flanges 98 flanking both ends of the drum 78. As depicted, the spool assembly 102 further comprises a cradle 104 (not labeled) to hold the drum 71 about the central axis 100. The cradle 104 may have two horizontal supports 106 that may be rotatable about the central axis 100 to provide support for the drum 71, similar to a folding table tray. The drum 71, flanges 98, and cradle 104 may be of any material capable of supporting the continuous cable 96 and able to withstand the temperature and pressure conditions in a downhole location. Such materials may include, but are not limited to, a metal (e.g., aluminum, steel, and the like), wood, a polymeric material (e.g., polystyrene, polyethylene, acrylonitrile butadiene styrene, polypropylene or polycarbonate, and the like), and the like, and combinations thereof.

The horizontal supports 106 may be used to mount the spool assembly 102 on the tubular body 41 of the cement head 30 (FIG. 2). Such mounting may be achieved by mechanical means (e.g., screws, clamps, latches, and the like), adhesive means, welding or soldering means, or may be permanently designed into the tubular body 41 of the cement head 30 such that the spool assembly 102 is not removable.

Other support mechanisms differing from the cradle 104 may also be used to arrange the spool assembly on the tubular body 41 of the cement head (FIG. 2), without departing from the scope of the present disclosure. For example, as shown in FIG. 2, the spool assembly may be arranged vertically on the tubular body 41, such as with a cable, wire, or other suspension mechanism through the central axis 100 (FIG. 4) of the drum 71.

Referring again to FIG. 2, in some embodiments, the present disclosure provides a method of releasing a retention device (not shown) retaining a cement plug (either or both of the bottom cement plug 58 and/or the top cement plug 60) through the borehole 45 of the cement head 30. The cement plug 58,60 then enters into the subterranean formation 18 through the casing string 20, wherein the continuous cable 74 is unspooled about the drum 71 of the spool assembly 72 as the cement plug 58,60 traverses the interior of the casing string, such that the location of the cement plug 58,60 may be determined.

In some embodiments, the physical amount of continuous cable 96 unspooled from the drum 71 is measured to determine the location of the cement plug 58,60 in the subterranean formation 18. This may be done, among other ways, by counting the number of rotations that the drum 71 makes about its central axis 100 (FIG. 3) after release of the cement plug 58,60 and multiplying the number of rotations by the circumference of the drum 71 to determine the length of continuous cable 96 spooled off the drum 71. Mathematical corrections may be applied to account for stretching of the continuous cable 96 due to temperature, pressure, tension, and the like, and combinations thereof.

In other embodiments, a signal source 120 may be located on the top of the cement plug 58,60 and in communication with the second end of the continuous cable 96. A signal may be transmitted from the signal source 120 through the continuous cable 96 beginning at the second end of the continuous cable 96 and to a detector 122 located at or near the first end of the continuous cable 96, such as on the drum 71 of the spool assembly 72, as shown in FIG. 2. The detector may then produce an output signal corresponding to a location of the cement plug 58,60 in the subterranean formation 18, such as by use of interferometry. In some embodiments, the output signal may be received by a signal processor (not shown) above the surface 14. The signal processor may communicably coupled to the detector 122 or may otherwise communicate with the detector 122 wirelessly. The signal processor may be a computer including a non-transitory machine-readable medium configured to display or otherwise output the output signal, corresponding to the location of the cement plug 58,60 in the subterranean formation 18.

In some embodiments, when the continuous cable 96 is an electrically conductive cable, the signal source 120 may be an electrical current signal source located on the top of the cement plug 58,60 and in electrical communication with the second end of the continuous cable 96. The electrical signal source may transmit an electrical current through the continuous cable 96 beginning at the second end thereof to be detected by the detector 122 at or near the first end of the continuous cable 96, wherein the detector detects the electrical current and the detected electrical current corresponds to a location of the cement plug 58,60 in the subterranean formation 18. In such instances, the electrical current signal source may include any signal source capable of producing electrical current that may travel through an electrically conductive cable. Such electrical current signal sources may include, but are not limited to, an independent electrical current source or a dependent electrical current source. The electrical current may include, but is not limited to, direct current, pulsed direct current, alternating current, and alternating pulsed direct current. The detector 122 may be an electrical current detector capable of detecting the electrical current such as by interferometry, voltage, current, and the like. Examples of such detectors may include, but are not limited to, a semiconductor detector, a piezo-electric detector, a charge coupled device (CCD) detector, and the like, and combinations thereof.

In other embodiments, the electrical current may be transmitted from signal source (not shown) in the form of the electrical current signal source in communication with the first end of the continuous cable 96. The electrical current may be transmitted through the continuous cable 96 beginning at the first end thereof and be reflected back up the continuous cable 96 beginning at the second end thereof by an electrical current reflector (not shown), followed by detecting the reflected electrical current with the detector 122 at or near the first end of the continuous cable 96, such as on or near the drum 71 of the spool assembly 72, as depicted in FIG. 2. In such instances, the reflected electrical current may correspond to a location of the cement plug 58,60 in the subterranean formation 18. The electrical current reflector may be located at a top portion of the cement plug 58,60 and in communication with the continuous cable 96 such that the electrical current reflector is able to receive and reflect the electrical current back up the continuous cable 96 to the detector 122. Such electrical current reflectors may be any reflector capable of reflecting electrical current including, but not limited to, an impedance discontinuity in the continuous cable 96 located at the second end thereof and on the cement plug 58,60 where the impedance discontinuity has a known reflection coefficient.

In some embodiments, when the continuous cable 96 is an optically conductive cable, the signal source 120 may be an electromagnetic radiation source located on the top of the cement plug 58,60 and in optical communication with the second end of the continuous cable 96. The electromagnetic radiation source may transmit an electromagnetic radiation through the continuous cable 96 beginning at the second end thereof to be detected by the detector 122 at or near the first end of the continuous cable 96, wherein the detector detects the electromagnetic radiation and the detected electromagnetic radiation corresponds to a location of the cement plug 58,60 in the subterranean formation 18. In such instances, the electromagnetic radiation source may include any signal source capable of producing electromagnetic radiation that may travel through an optically conductive cable. Such electromagnetic radiation sources may include, but are not limited to, a light bulb, a light emitting device (LED), a laser, a blackbody, a photonic crystal, an X-Ray source, a gamma ray source, and the like, and combinations thereof. The detector 122 that is an electromagnetic radiation detector capable of detecting the electromagnetic radiation may include, but is not limited to, an optical transducer, such as a photodiode, a photon detector (e.g., a photomultiplier tube), a quad detector, a video or array detector, a split detector, and the like and any combination thereof. Other optical transducers than may operate as an electromagnetic radiation detector may include, but are not limited to, a thermal detector (e.g., a thermopile or photoacoustic detector), a semiconductor detector, a piezo-electric detector, a charge coupled device (CCD) detector, and the like, and any combination thereof. The electromagnetic radiation may be detected by interferometry, for example.

In other embodiments, the electromagnetic radiation may be transmitted from signal source (not shown) in the form of the electromagnetic radiation source in communication with the first end of the continuous cable 96. The electromagnetic radiation may be transmitted through the continuous cable 96 beginning at the first end thereof and be reflected back up the continuous cable 96 beginning at the second end thereof by an electromagnetic radiation reflector (not shown), followed by detecting the reflected electromagnetic radiation with the detector 122 at or near the first end of the continuous cable 96, such as on or near the drum 71 of the spool assembly 72, as depicted in FIG. 2. In such instances, the reflected electromagnetic radiation may correspond to a location of the cement plug 58,60 in the subterranean formation 18. The electromagnetic radiation reflector may be located at a top portion of the cement plug 58,60 and in communication with the continuous cable 96 such that the electromagnetic radiation reflector is able to receive and reflect the electromagnetic radiation back up the continuous cable 96 to the detector 122. Such electromagnetic radiation reflectors may be any reflector capable of reflecting electromagnetic radiation including, but not limited to, a normal lens, a Fresnel lens, a diffractive optical element, a holographic graphical element, a mirror (e.g., a focusing mirror), a type of collimator, and the like, and any combination thereof.

In some embodiments, when the continuous cable 96 is an acoustically conductive cable, the signal source 120 may be an acoustic signal source located on the top of the cement plug 58,60 and in acoustic communication with the second end of the continuous cable 96. The acoustic signal source may transmit an acoustic signal through the continuous cable 96 beginning at the second end thereof to be detected by the detector 122 at or near the first end of the continuous cable 96, wherein the detector detects the acoustic signal and the detected acoustic signal corresponds to a location of the cement plug 58,60 in the subterranean formation 18. In such instances, the acoustic signal source may include any signal source capable of producing an acoustic signal that may travel through an acoustically conductive cable. Such acoustic signal sources may include, but are not limited to, a single or array of acoustic transducers that may detect the acoustic signal such as by interferometry.

In other embodiments, the acoustic signal may be transmitted from signal source (not shown) in the form of the acoustic signal source in communication with the first end of the continuous cable 96. The acoustic signal may be transmitted through the continuous cable 96 beginning at the first end thereof and be reflected back up the continuous cable 96 beginning at the second end thereof by an acoustic signal reflector (not shown), followed by detecting the reflected acoustic signal with the detector 122 at or near the first end of the continuous cable 96, such as on or near the drum 71 of the spool assembly 72, as depicted in FIG. 2. In such instances, the reflected acoustic signal may correspond to a location of the cement plug 58,60 in the subterranean formation 18. The acoustic signal reflector may be located at a top portion of the cement plug 58,60 and in communication with the continuous cable 96 such that the acoustic signal reflector is able to receive and reflect the acoustic signal back up the continuous cable 96 to the detector 122. Such acoustic signal reflectors may be any reflector capable of reflecting acoustic signal including, but not limited to, an acoustic mirror, acoustic reflective panels, and the like, and any combination thereof.

In yet other embodiments, one or both of the cement plugs 58,60 may further comprise a sensor located either on the outer portion 90 or the insert 70 (FIGS. 3A,3B), or at any other location thereon that does not interfere with the function of the cement plug 58,60, the cement head 30, or the spool assembly 72 described herein. Such sensors may be configured to sense certain parameters related to the cement plug 58,60 or the environment surrounding the cement plugs 58,60 including, but are not limited to, pressure, temperature, mechanical integrity, surrounding fluid viscosity, surrounding fluid content (e.g., di-electric measurements, $CO_2$ concentration, acidity, pH, and the like), and the like, and any combination thereof.

Embodiments disclosed herein include:

Embodiment A: A cement head comprising: a tubular body having a top end and a bottom end, and a borehole arranged through at least a portion of the tubular body; a cement plug arranged in the borehole and configured to exit the cement head upon releasing a retention device; and a spool assembly arranged on the tubular body, wherein the spool assembly comprises a drum rotatable about a central axis and a continuous cable having a first end and a second end, the first end being attached to the drum and the second end being attached to the cement plug, and wherein rotating the drum about the central axis results in spooling or unspooling the continuous cable about the drum.

Embodiment A may have one or more of the following additional elements in any combination:

Element A1: Wherein the spool assembly is at least partially recessed within the borehole.

Element A2: Wherein the central axis is substantially horizontal or substantially vertical.

Element A3: Wherein the continuous cable is selected from the group consisting of an electrically conductive cable, an optically conductive cable, an acoustically conductive cable, and any combination thereof.

Element A4: Wherein arranged on the cement plug is a signal source selected from the group consisting of an electrical current source, an electromagnetic source, an acoustic source, and any combination thereof, the signal source in communication with the second end of the continuous cable.

Element A5: Wherein arranged on the cement plug is a signal reflector selected from the group consisting of an electrical current reflector, an electromagnetic radiation reflector, an acoustic signal reflector, and any combination thereof, the signal reflector in communication with the second end of the continuous cable.

Element A6: Further comprising a sensor arranged on the cement plug for measuring parameters related to the cement plug and/or the location of the cement plug.

Element A7: Further comprising a sensor arranged on the cement plug for measuring parameters related to the cement plug and/or the location of the cement plug, wherein the sensor is selected from the group consisting of a temperature sensor, a pressure sensor, a conductivity sensor, a vibration sensor, an accelerometer sensor, an impedance sensor, and any combination thereof.

By way of non-limiting example, exemplary combinations applicable to A include: A with A1 and A2; A with A1 and A3; A with A1 and A4; A with A1 and A5; A with A1 and A6; A with A1 and A7; A with A2 and A3; A with A2 and A4; A with A2 and A5; A with A2 and A6; A with A2 and A7; A with A3 and A4; A with A3 and A5; A with A3 and A6; A with A4 and A5; A with A4 and A6; A with A4 and A7; A with A5 and A6; A with A5 and A7; A with A6 and A7; A with A1, A2, A3, A4, A5, A6, and A7; A with A1, A2, A3, A4, A5, and A6; A with A1, A4, and A6; A with A3, A4, and A5; and the like.

Embodiment B: A method comprising: providing a cement head comprising: a tubular body having a top end and a bottom end, and a borehole arranged through at least a portion of the tubular body; a cement plug arranged in the borehole and configured to exit the cement head upon releasing a retention device; a spool assembly arranged on the tubular body, wherein the spool assembly comprises a drum rotatable about a central axis and a continuous cable having a first end and a second end, the first end being attached to the drum and the second end being attached to the cement plug, and wherein rotating the drum about the central axis results in spooling or unspooling the continuous cable about the drum; arranging the cement head at a top location of a casing string in a subterranean formation as part of a cementing operation; and releasing the retention device causing the cement plug to exit the borehole into the subterranean formation through an interior of the casing string, wherein the continuous cable is unspooled about the drum as the cement plug traverses the interior of the casing string.

Embodiment B may have one or more of the following additional elements in any combination:

Element B1: Wherein the spool assembly is at least partially recessed within the borehole.

Element B2: Wherein the central axis is substantially horizontal or substantially vertical.

Element B3: Further comprising determining a location of the cement plug as it is introduced into the subterranean formation by measuring the amount of continuous cable unspooled about the drum.

Element B4: Wherein the continuous cable is an electrically conductive cable, and an electrical current signal source is arranged on the cement plug in communication with the second end of the continuous cable, and further comprising: transmitting an electrical current from the electrical current signal source through the continuous cable beginning at the second end thereof, and detecting the electrical current with a detector at or near the first end of the continuous cable, wherein the detected electrical current corresponds to a location of the cement plug in the subterranean formation.

Element B5: Wherein the continuous cable is an electrically conductive cable and an electrical current reflector is arranged on the cement plug in communication with the second end of the continuous cable, and further comprising: transmitting an electrical current through the continuous cable beginning at the first end thereof, reflecting the electrical current with the electrical current reflector back through the continuous cable beginning at the second end thereof, and detecting the reflected electrical current with a detector at or near the first end of the continuous cable, wherein the detected reflected electrical current corresponds to a location of the cement plug in the subterranean formation.

Element B6: wherein the continuous cable is an optically conductive cable, and an electromagnetic radiation source is arranged on the cement plug in communication with the second end of the continuous cable, and further comprising: transmitting electromagnetic radiation from the electromagnetic radiation source through the continuous cable beginning at the second end thereof, and detecting the electromagnetic radiation with a detector at or near the first end of the continuous cable, wherein the detected electromagnetic radiation corresponds to a location of the cement plug in the subterranean formation.

Element B7: Wherein the continuous cable is an optically conductive cable and an electromagnetic radiation reflector is arranged on the cement plug in communication with the second end of the continuous cable, and further comprising: transmitting electromagnetic radiation through the continuous cable beginning at the first end thereof, reflecting the electromagnetic radiation with the electromagnetic radiation reflector back through the continuous cable beginning at the second end thereof, and detecting the reflected electromagnetic radiation with a detector at or near the first end of the continuous cable, wherein the detected reflected electromagnetic radiation corresponds to a location of the cement plug in the subterranean formation.

Element B8: wherein the continuous cable is an acoustically conductive cable, and an acoustic signal source is arranged on the cement plug in communication with the second end of the continuous cable, and further comprising: transmitting an acoustic signal from the acoustic signal source through the continuous cable beginning at the second end thereof, and detecting the acoustic signal with a detector at or near the first end of the continuous cable, wherein the detected acoustic signal corresponds to a location of the cement plug in the subterranean formation.

Element B9: wherein the continuous cable is an acoustically conductive cable and an acoustic signal reflector is arranged on the cement plug in communication with the second end of the continuous cable, and further comprising: transmitting an acoustic signal through the continuous cable beginning at the first end thereof, reflecting the acoustic signal with the acoustic signal reflector back through the continuous cable beginning at the second end thereof, and detecting the reflected acoustic signal with a detector at or near the first end of the continuous cable, wherein the detected reflected acoustic signal corresponds to a location of the cement plug in the subterranean formation.

Element B10: Wherein a sensor is arranged on the cement plug, and further comprising measuring a parameter related to the cement plug and/or the location of the cement plug.

By way of non-limiting example, exemplary combinations applicable to B include: B with B1 and B2; B with B1 and B3; B with B1 and B4; B with B1 and B5; B with B1 and B6; B with B1 and B7; B with B1 and B8; B with B1 and B9; B with B1 and B10; B with B2 and B3; B with B2 and B4; B with B2 and B5; B with B2 and B6; B with B2 and B7; B with B2 and B8; B with B2 and B9; B with B2 and B10; B with B3 and B4; B with B3 and B5; B with B3 and B6; B with B3 and B7; B with B3 and B8; B with B3 and B9; B with B3 and B10; B with B4 and B5; B with B4 and B6; B with B4 and B7; B with B4 and B8; B with B4 and B9; B with B4 and B10; B with B5 and B6; B with B5 and B7; B with B5 and B8; B with B5 and B9; B with B5 and B10; B with B6 and B7; B with B6 and B8; B with B6 and B9; B with B6 and B10; B with B7 and B8; B with B7 and B9; B with B7 and B10; B with B8 and B9; B with B8 and B10; B with B9 and B10; B with B1, B2, B3, B4, B5, B6, B7, B8, B9, and B10; B with B1, B2, B3, B4, B5, and B6; B with B1, B4, and B6; B with B3, B4, and B5; and the like.

Embodiment C: A system comprising: a wellbore in a subterranean formation; and a cement plug located within the wellbore, the cement plug comprising: a body having a top end and a bottom end, and a borehole arranged through at least a portion of the tubular body; and a spool assembly mounted to the top end of the body, wherein the spool assembly comprises a drum rotatable about a central axis and a continuous cable having a first end and a second end, the first end being attached to the drum, and wherein rotating the drum about the central axis results in spooling or unspooling the continuous cable about the drum.

Embodiments C may have one or more of the following additional elements in any combination:

Element C1: Wherein the spool assembly is at least partially recessed within the borehole.

Element C2: Wherein the central axis is substantially horizontal or substantially vertical.

Element C3: Wherein the continuous cable is selected from the group consisting of an electrically conductive cable, an optically conductive cable, an acoustically conductive cable, and any combination thereof.

Element C4: Wherein arranged on the cement plug is a signal source selected from the group consisting of an electrical current source, an electromagnetic source, an acoustic source, and any combination thereof, the signal source in communication with the second end of the continuous cable.

Element C5: Wherein arranged on the cement plug is a signal reflector selected from the group consisting of an electrical current reflector, an electromagnetic radiation reflector, an acoustic signal reflector, and any combination thereof, the signal reflector in communication with the second end of the continuous cable.

Element C6: Further comprising a sensor arranged on the cement plug for measuring parameters related to the cement plug and/or the location of the cement plug.

Element C7: Further comprising a sensor arranged on the cement plug for measuring parameters related to the cement plug and/or the location of the cement plug, wherein the sensor is selected from the group consisting of a temperature sensor, a pressure sensor, a conductivity sensor, a vibration sensor, an accelerometer sensor, an impedance sensor, and any combination thereof.

By way of non-limiting example, exemplary combinations applicable to C include: C with C1 and C2; C with C1 and C3; C with C1 and C4; C with C1 and C5; C with C1 and C6; C with C1 and C7; C with C2 and C3; C with C2 and C4; C with C2 and C5; C with C2 and C6; C with C2 and C7; C with C3 and C4; C with C3 and C5; C with C3 and C6; C with C4 and C5; C with C4 and C6; C with C4 and C7; C with C5 and C6; C with C5 and C7; C with C6 and C7; C with C1, C2, C3, C4, C5, C6, and C7; C with C1, C2, C4, C5, and C6; C with C1, C3, and C5; C with C2, C3, and C7; and the like.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The embodiments illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A cement head comprising:

a tubular body having a top end and a bottom end, and a borehole arranged through at least a portion of the tubular body;

a first cement plug arranged in the borehole, wherein the first cement plug comprises a substantially solid insert having a void in a bottom portion of the insert;

a second cement plug arranged in the borehole below the first cement plug and configured to exit the cement head upon releasing a retention device, wherein the second cement plug comprises an eyehook configured to fit within the void of the first cement plug; and a spool assembly arranged on the tubular body, wherein the spool assembly comprises a drum rotatable about a central axis and a continuous cable having a first end and a second end, the first end being attached to the drum and the second end being attached to the second cement plug, and wherein rotating the drum about the central axis results in spooling or unspooling the continuous cable about the drum.

2. The cement head of claim 1, wherein the spool assembly is at least partially recessed within the borehole.

3. The cement head of claim 1, wherein the continuous cable is selected from the group consisting of an electrically conductive cable, an optically conductive cable, an acoustically conductive cable, and any combination thereof.

4. The cement head of claim 1, wherein arranged on the first or the second cement plug is a signal source selected from the group consisting of an electrical current source, an electromagnetic source, an acoustic source, and any combination thereof, the signal source in communication with the second end of the continuous cable.

5. The cement head of claim 1, wherein arranged on the first or the second cement plug is a signal reflector selected from the group consisting of an electrical current reflector, an electromagnetic radiation reflector, an acoustic signal reflector, and any combination thereof, the signal reflector in communication with the second end of the continuous cable.

6. The cement head of claim 1, further comprising a sensor arranged on the first or the second cement plug for measuring parameters related to the first or the second cement plug and/or a location of the first or the second cement plug.

7. The cement head of claim 6, wherein the sensor is selected from the group consisting of a temperature sensor, a pressure sensor, a conductivity sensor, a vibration sensor, an accelerometer sensor, an impedance sensor, and any combination thereof.

8. The cement head of claim 1, further comprising:

a first valve and a second valve vertically spaced along the tubular body;

wherein the first cement plug is arranged between the first valve and the second valve, wherein the second cement plug is arranged below the second valve.

9. The cement head of claim 1, further comprising a pump configured to supply pressurized fluid to the borehole to cause the second cement plug to exit the cement head upon releasing the retention device.

10. A method comprising:

providing a cement head comprising:

a tubular body having a top end and a bottom end, and a borehole arranged through at least a portion of the tubular body;

a first cement plug arranged in the borehole, wherein the first cement plug comprises a substantially solid insert having a void in a bottom portion of the insert;

a second cement plug arranged in the borehole below the first cement plug and configured to exit the cement head upon releasing a retention device, wherein the second cement plug comprises an eye-hook configured to fit within the void of the first cement plug; and a spool assembly arranged on the tubular body, wherein the spool assembly comprises a drum rotatable about a central axis and a continuous cable having a first end and a second end, the first end being attached to the drum and the second end being attached to the cement plug, and wherein rotating the drum about the central axis results in spooling or unspooling the continuous cable about the drum;

arranging the cement head at a top location of a casing string in a subterranean formation as part of a cementing operation; and releasing the retention device causing the second cement plug to exit the borehole into the subterranean formation through an interior of the casing string, wherein the continuous cable is unspooled about the drum as the second cement plug traverses the interior of the casing string.

11. The method of claim 10, wherein the spool assembly is at least partially recessed within the borehole.

12. The method of claim 10, further comprising determining a location of the second cement plug as it is introduced into the subterranean formation by measuring an amount of continuous cable unspooled about the drum.

13. The method of claim 10, wherein the continuous cable is an electrically conductive cable, and an electrical current signal source is arranged on the second cement plug in communication with the second end of the continuous cable, and further comprising:

transmitting an electrical current from the electrical current signal source through the continuous cable beginning at the second end thereof; and detecting the electrical current with a detector at or near the first end of the continuous cable, wherein the detected electrical current corresponds to a location of the second cement plug in the subterranean formation.

14. The method of claim 10, wherein the continuous cable is an electrically conductive cable and an electrical current reflector is arranged on the cement plug in communication with the second end of the continuous cable, and further comprising:

transmitting an electrical current through the continuous cable beginning at the first end thereof;

reflecting the electrical current with the electrical current reflector back through the continuous cable beginning at the second end thereof; and detecting the reflected electrical current with a detector at or near the first end of the continuous cable, wherein the detected reflected electrical current corresponds to a location of the cement plug in the subterranean formation.

15. The method of claim 10, wherein the continuous cable is an optically conductive cable, and an electromagnetic radiation source is arranged on the cement plug in communication with the second end of the continuous cable, and further comprising:

transmitting electromagnetic radiation from the electromagnetic radiation source through the continuous cable beginning at the second end thereof; and detecting the electromagnetic radiation with a detector at or near the first end of the continuous cable, wherein the detected electromagnetic radiation corresponds to a location of the cement plug in the subterranean formation.

16. The method of claim 10, wherein the continuous cable is an optically conductive cable and an electromagnetic radiation reflector is arranged on the cement plug in communication with the second end of the continuous cable, and further comprising:

transmitting electromagnetic radiation through the continuous cable beginning at the first end thereof;

reflecting the electromagnetic radiation with the electromagnetic radiation reflector back through the continuous cable beginning at the second end thereof; and detecting the reflected electromagnetic radiation with a detector at or near the first end of the continuous cable, wherein the detected reflected electromagnetic radiation corresponds to a location of the cement plug in the subterranean formation.

17. The method of claim 10, wherein the continuous cable is an acoustically conductive cable, and an acoustic signal source is arranged on the cement plug in communication with the second end of the continuous cable, and further comprising:

transmitting an acoustic signal from the acoustic signal source through the continuous cable beginning at the second end thereof; and detecting the acoustic signal with a detector at or near the first end of the continuous cable, wherein the detected acoustic signal corresponds to a location of the second cement plug in the subterranean formation.

18. The method of claim 10, wherein the continuous cable is an acoustically conductive cable and an acoustic signal reflector is arranged on the cement plug in communication with the second end of the continuous cable, and further comprising:

transmitting an acoustic signal through the continuous cable beginning at the first end thereof;

reflecting the acoustic signal with the acoustic signal reflector back through the continuous cable beginning at the second end thereof; and detecting the reflected acoustic signal with a detector at or near the first end of the continuous cable, wherein the detected reflected acoustic signal corresponds to a location of the second cement plug in the subterranean formation.

19. The method of claim 10, wherein a sensor is arranged on the first or the second cement plug, and further comprising measuring a parameter related to the first or the second cement plug and/or the location of the first or the second cement plug.

20. A system comprising:

a wellbore in a subterranean formation; and a cement head comprising:

a body having a top end and a bottom end, and a borehole arranged through at least a portion of the body;

a first cement plug arranged in the borehole, wherein the first cement plug comprises a substantially solid insert having a void in a bottom portion of the insert;

a second cement plug arranged in the borehole below the first cement plug and configured to exit the cement head and enter the wellbore upon releasing a retention device, wherein the second cement plug comprises an eyehook configured to fit within the void of the first cement plug; and a spool assembly mounted to the top end of the body, wherein the spool assembly comprises a drum rotatable about a central axis and a continuous cable having a first end and a second end, the first end being attached to the drum, and wherein rotating the drum about the central axis results in spooling or unspooling the continuous cable about the drum.

* * * * *